US006314942B1

(12) United States Patent
Kilgore et al.

(10) Patent No.: US 6,314,942 B1
(45) Date of Patent: Nov. 13, 2001

(54) FUEL PRESSURE DAMPENING ELEMENT

(75) Inventors: Jason T. Kilgore, Newport News; Barry S. Robinson, Williamsburg, both of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/557,621

(22) Filed: Apr. 25, 2000

(51) Int. Cl.[7] ..... F02M 37/04; F15B 1/04
(52) U.S. Cl. ..... 123/467; 138/28
(58) Field of Search ..... 123/467, 456, 123/468, 470; 138/26, 28

(56) References Cited

U.S. PATENT DOCUMENTS 2,409,304 * 10/1946 Morrison ..... 138/26
4,651,781 * 3/1987 Kandelman ..... 138/28
4,823,844 * 4/1989 Bartholomew ..... 138/28
5,575,262 * 11/1996 Rohde ..... 123/467
5,617,827 * 4/1997 Eshleman ..... 123/456
5,709,248 * 1/1998 Goloff ..... 138/30
5,845,621 * 12/1998 Robinson et al. ..... 123/456
5,896,843 * 4/1999 Lorraine ..... 123/467

* cited by examiner

*Primary Examiner*—Thomas N. Moulis

(57) ABSTRACT

A fuel rail assembly is disclosed. The fuel rail assembly includes a generally hollow fuel rail having a longitudinal rail axis extending therethrough and a fuel damper element having a wall and a longitudinal damper element axis extending therethrough. The fuel damper element is located within the fuel rail. The damper axis is generally parallel with the rail axis. A method of forming the fuel rail assembly is also disclosed.

22 Claims, 2 Drawing Sheets

FUEL PRESSURE DAMPENING ELEMENT

FIELD OF THE INVENTION

This invention relates to pressure dampers for use in fuel delivery systems for engines for motor vehicles.

BACKGROUND OF THE INVENTION

In fuel rails for injector-based fuel injection systems, the various devices associated with the fuel system cause pressure waves in the fuel to propagate through the fuel rails. Such pressure waves, if occurring at the wrong time, may have a small amount of fuel leaving the fuel rail and being injected into the engine at the time the injector is pulsed open. In addition, such pressure waves cause noise in the system that may be objectionable. Pressure pulses will give false readings to fuel pressure regulators by operating the regulator with a false indication of fuel pressure, which may result in fuel being bypassed and returned to the fuel tank.

A known pressure dampening system uses elastic walls forming the fuel supply line. As pressure pulses occur, the elastic walls function to dampen the pressure pulsations. Other pressure dampening systems use a pressure damper plugged in the end of a fuel rail with a pressure regulator at the other end. Still other pressure dampening systems use a compliant member operable to reduce peak pressure during injector firing events. The member is positioned in the fuel rail so as to not adversely affect the flow of fuel to an injector opening in the rail. The member is not free to rotate in the rail and the pressure pulses are dampened by the member, which is a pair of welded together shell halves with an enclosed airspace. Other pressure dampening systems use an in-line fuel pressure damper from the outlet of the fuel filter to the fuel rail. The damper is a pressure accumulator which operative to reduce transient pressure fluctuations induced by the fuel pump and the opening and closing of the fuel injectors.

Another dampening system utilizes an integral pressure damper that is attached to the fuel rail. The return tube is brazed to the rail and then at a convenient time in the assembly process the damper, which is a diaphragm, is attached to the return tube and crimped into position. The diaphragm operates to reduce audible operating noise produced by the injector pressure pulsations.

Still another dampening system uses a pulse damper in the fuel pump comprising a hollow body formed of a thin walled tube of flexible and resilient plastic material with heat sealed ends forming at least one chamber. The chamber carries a compressible gas to dampen pressure pulsations. Another dampening system uses a bellows modulator inside a gear rotor fuel pump for reducing pump noise by reducing the amplitude of fuel pressure pulses. Yet another system uses a bellows-like device at the junction of the lines of the flow path of the fluid from a fuel feed pump thereby forming a discontinuity in the flow path to reduce compressional vibrations of fuel being conveyed.

It would be beneficial to develop a dampening element that is relatively compact and inexpensive to manufacture and install.

BRIEF SUMMARY OF THE INVENTION

Briefly, the present invention provides a fuel rail assembly. The fuel rail assembly comprises a generally hollow fuel rail having a longitudinal rail axis extending therethrough and a fuel damper element having a wall and a longitudinal damper element axis extending therethrough. The fuel damper element is located within the fuel rail. The damper element axis is generally parallel with the rail axis.

The present invention also provides a dampening element for a fluid conduit. The dampening element comprises an elongated member adapted to be inserted into the fluid conduit. The elongated member has at least one generally rounded portion extending along a length of the member.

Additionally, the present invention provides a method of reducing pressure pulsations in a fluid conduit. The method comprises providing a fluid conduit with a dampening element located therein, the dampening element having an elongated member having at least one generally rounded portion extending along a length of the member; and flowing pressurized fluid through the fluid conduit.

Additionally, the present invention provides a method of forming a fuel rail assembly. The method comprises compressing a wall of an elongated member toward a longitudinal axis of the element in at least two locations along a length of the member, forming at least one generally rounded portion; and inserting the elongated member into a fuel rail.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the futures of the invention. In the drawings.

DETAILED DESCRIPTION OF THE PREFERRED EMBODIMENT

Figure 1:
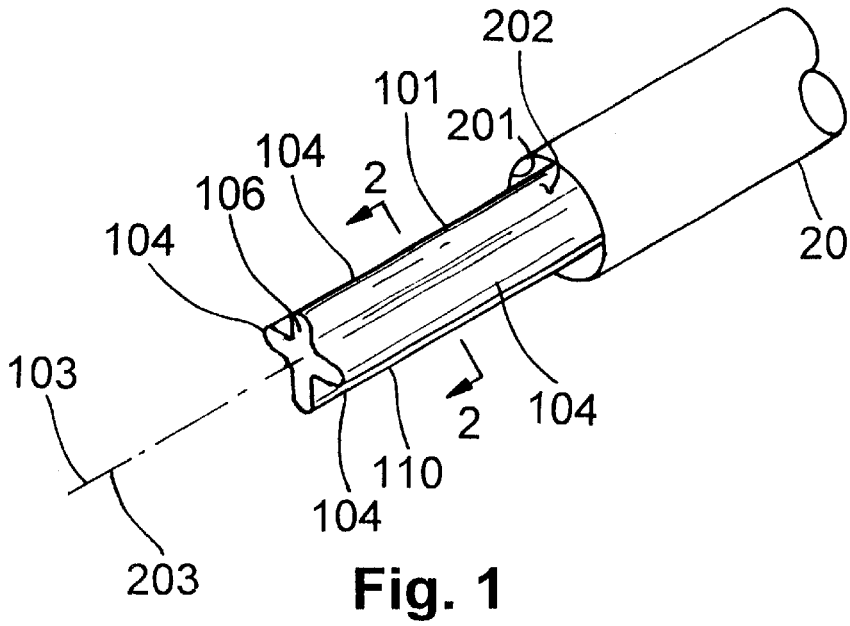
FIG. 1 is a perspective view of a dampening element according to a first preferred embodiment of the present invention, installed in a fuel line.
Figure 2:
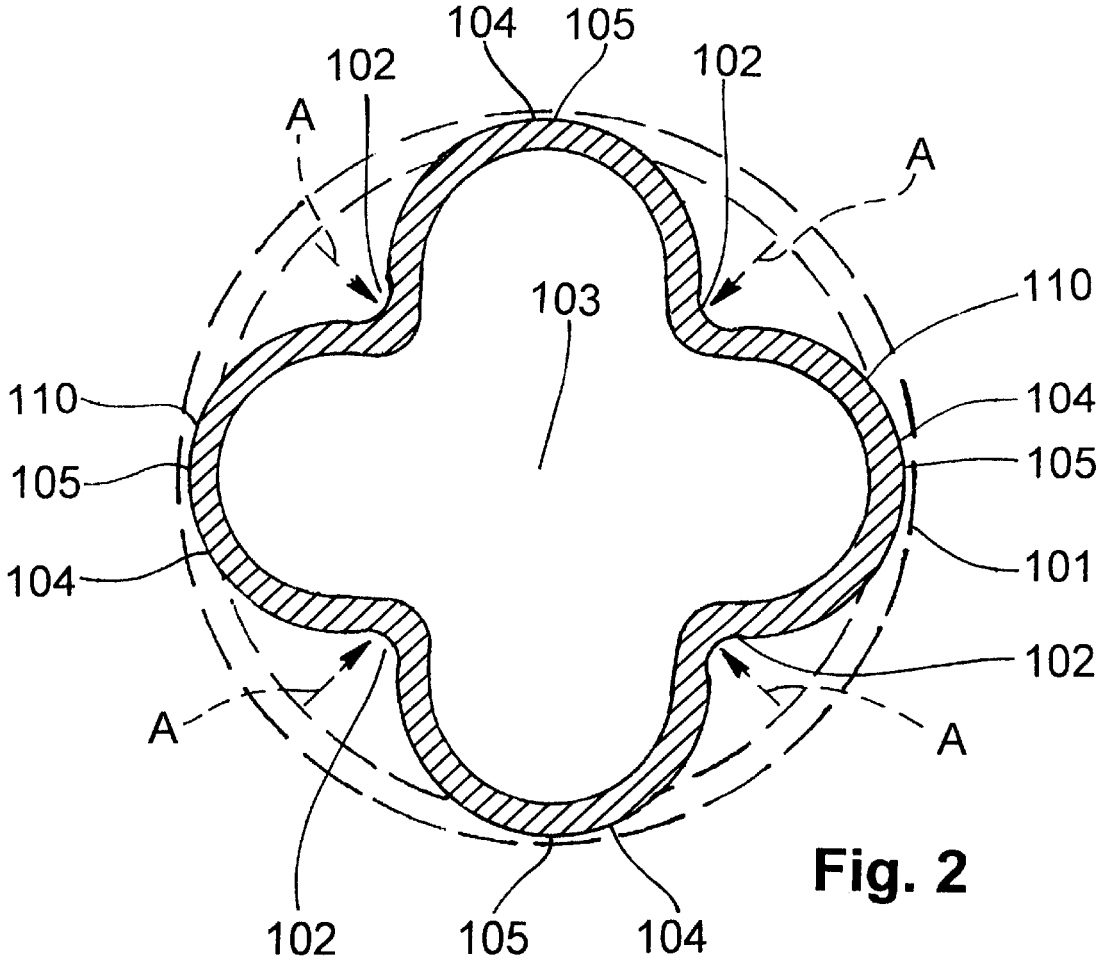
FIG. 2 is a side view, in section, of the dampening element of FIG. 1, taken along line 2—2 of FIG. 1.

In the drawings, like numerals are used to indicate like elements throughout. A fuel dampening element 110 according to a preferred embodiment of the present invention is shown in FIGS. 1 and 2. The fuel dampening member or element 110 (hereinafter "element 110") is adapted to be inserted into a generally hollow fluid conduit, such as fuel rail 20, as shown in FIG. 1. The element 100 inserted into the fuel rail 20 forms a fuel rail assembly 100. The fuel rail 20 may be found in the fuel management system of a motor vehicle. In an integrated air-fuel module, the fuel rail assembly is a passageway or passageways for either or both a liquid such as gasoline or a non-liquid fluid, such as air or gas. This particular fuel rail 20 has a plurality of injector cups (not shown), each for receiving a fuel injector (not shown). The fuel rail 20 has an internal wall 201 which has an internal perimeter, and a longitudinal rail axis 203 extending therethrough.

Preferably, the element 110 is constructed from an elongated single piece of hollow, thin walled stainless steel tubing, Inconel, or electrodeposited nickel, although those skilled in the art will recognize that the element 110 can be constructed from other suitable materials as well, so long as the material can withstand the fluids or fuels that are transported by the fuel rail 20. Additionally, the element 110 can be other shapes instead of tubular, including box-shaped, or other suitable shapes. In the preferred embodiment, the element 110 originates as a tubular piece having an exterior wall 101, shown by the dashed lines in FIG. 2. The exterior wall 101 is compressed toward a longitudinal axis 103 of the element 110 at four locations 102 along the length of the element 110, as shown by the dashed arrows A. Preferably, the wall 101 is compressed by pinching the wall 101 toward the longitudinal axis 103 using pins and rollers, although those skilled in the art will recognize that other tools and techniques, such as using interior and exterior dies, can be used. Alternatively, the element 110 can be formed by extrusion, as is well known in the art.

By compressing the wall 101 at four locations, four generally rounded or semi-elliptical portions or lobes 104 which extend from the longitudinal axis 103 are formed along the length of the element 110, such that a cross-section of the element 110, as shown in FIG. 2, gives the appearance of a cross. A tip 105 on the wall 101 of each lobe 104 is preferably approximately a same first distance from the longitudinal axis 103 as the tip 105 on the wall 101 of each other lobe 104, and all locations on the wall 101 between adjacent lobe tips 105 are less than the first distance from the longitudinal axis 103. Free ends 106 of the element 110 are pinched together and sealed, preferably by a laser weld, although those skilled in the art will recognize that the free ends 106 can be sealed by other methods, such as, for example, chemical bonding, as well.

Preferably, the element 110 has a nominal outside diameter of approximately 9.5 mm (⅜ inches), a wall 101 thickness of approximately 0.15 mm (0.006 inches) and a length of approximately 127 mm (5 inches). However, those skilled in the art will recognize that the thickness and length of the wall 101 can be other dimensions as well. The wall 101 is very thin, hence very sensitive to pulsed pressure signals. The function of the element 110 is to receive the pulsed fuel pressure signals in compression by compressing or when in tension by expanding, to smooth out pressure peaks so as to reduce the pressure pulsations in the fuel rail 20 and to provide a relatively laminar flow of the fuel or fluid in the fuel rail 20 and into each injector as the respective injector is opened. The element 110, having its lobes 104 formed from the wall 101, provides the resiliency necessary to absorb the pressure pulses. The pressure pulses, acting on the plurality of the lobes 104, operate to compress or stretch the lobes 104, which thereby absorb the pulsed pressure. The lobes 104 may be in either a compression mode or in a tension mode. The relatively large amount of surface area of the wall 101 within a small volume inside the fuel rail 20 provides a large surface area for absorbing the pulsed pressure signals.

The element 10 is installed in an open end of the fuel rail 20 such that the longitudinal axis 103 of the element 110 is generally parallel to the longitudinal axis 203 of the fuel rail 20. The element 110 can be secured to the fuel rail 20 by a clip (not shown), or can be freely inserted in the fuel rail 20, allowing the element 110 to float within the fuel rail 20. Preferably, the fuel rail 20 has a nominal 19 mm (¾ inch) diameter. When using an element 110 having an outside diameter of approximately 9.5 mm, the ratio of the diameter of the fuel rail 20 to the element 110 is approximately 2:1. Pressurized fuel flows through the fuel rail 20 in the areas 202 within the fuel rail 20 which are not occupied by the element 110.

An additional benefit of the preferred embodiment of the element 110 is that the element 110 provides internal structural support to the fuel rail 20. In the event that an external compression force is applied to the fuel rail 20, the element 110 acts as a stiffener which may prevent the fuel rail 20 from totally collapsing.

Preferably, the element 110 is used in non-return fuel systems, although those skilled in the art will recognize that the element 110 can be used in any type of fuel system in which pressure pulsations would potentially occur.

Figure 3:
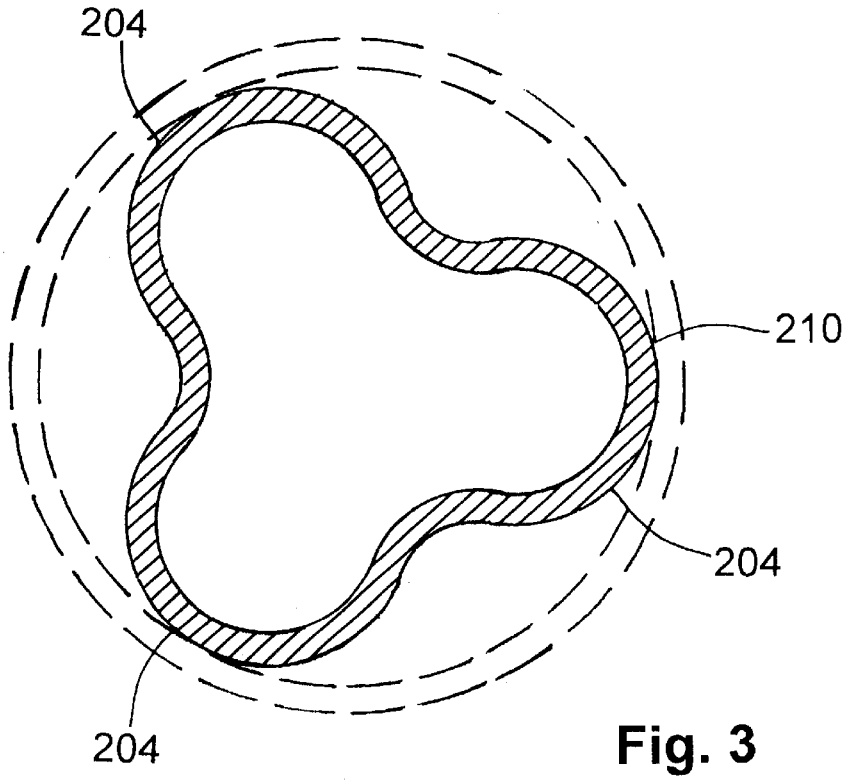
FIG. 3 is a side view, in section, of a dampening element according to a second preferred embodiment of the present invention.
Figure 4:
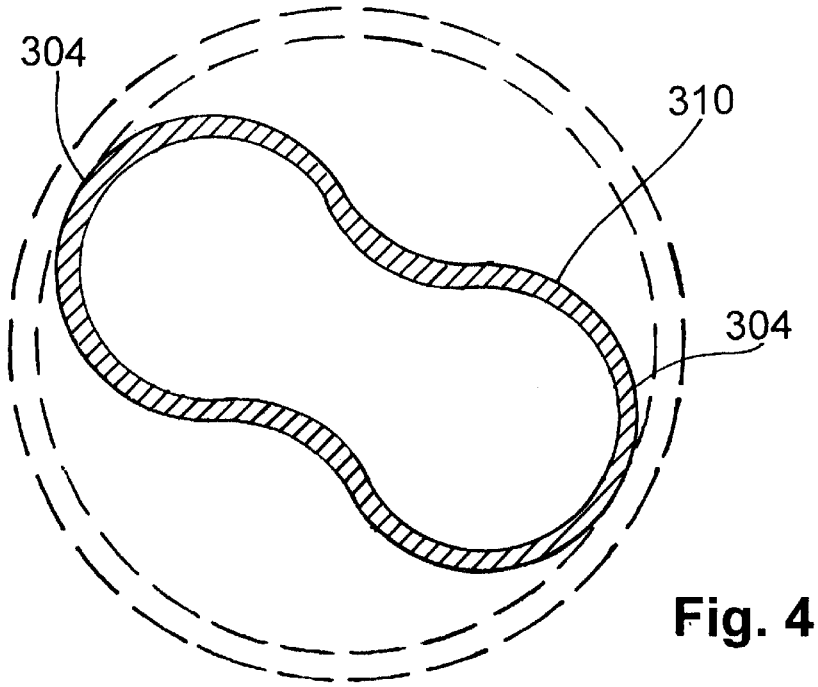
FIG. 4 is a side view, in section, of a dampening element according to a third preferred embodiment of the present invention.

Although four lobes are preferred, other embodiments with less than or more than four lobes can be used. For example, FIGS. 3 and 4 show elements 210 and 310 having three lobes 204 and two lobes 304, respectively, which can be used. Preferably, the lobes 104, 204, 304 are all symmetrically spaced about the longitudinal axis, although those skilled in the art will recognized that the lobes 104, 204, 304 need not be symmetrically spaced. Additionally, although the lobes 104, 204, 304 are preferably the same size as respective lobes 104, 203, 304 in the same element 110, those skilled in the art will recognize that the lobes 104, 204, 304 need not be the same size. Further, although the lobes 104, 204, 304 are preferably rounded or semi-elliptical in shape, those skilled in the art will recognize that the lobes 104, 204, 304 can be other shapes as well.

The use of element 110 has been shown in a fuel rail 20, although such a damper may be positioned in other parts of a fuel or fluid systems such as in cooperation with molded passageways. Such other areas are in pressure regulator, fuel pump motors or any place wherein pressure pulses occur.

It will be appreciated by those skilled in the art that changes could be made to the embodiment described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A fuel rail assembly comprising:

a generally hollow fuel rail having a wall surface and a longitudinal rail axis, the generally hollow fuel rail permitting fuel flow therethrough;

a fuel damper element having a wall spaced from a longitudinal damper element axis, the fuel damper configured to float within the fuel rail and permits fuel flow between the fuel damper element and the wall surface of the fuel rail; and at least one first distance between the wall of the fuel damper element and the longitudinal damper element axis differs from at least one second distance between the wall of the fuel damper element and the longitudinal damper element axis, the wall including a first generally rounded portion extending from the damper element axis and a second generally rounded portion extending from the damper element axis, the first and second generally rounded portions being symmetrically spaced about the damper element axis.

2. The fuel rail assembly according to claim 1, wherein the fuel damper element comprises a hollow member.

3. The fuel rail assembly according to claim 1, further comprising a third generally rounded portion extending from the damper element axis, with the first, second, and third generally rounded portions being symmetrically spaced about the damper element axis.

4. The fuel rail assembly according to claim 3, further comprising a fourth generally rounded portion extending from the damper element axis, with the first, second, third, and fourth generally rounded portions being symmetrically spaced about the damper element axis.

5. The fuel rail assembly according to claim 1, wherein the damper element includes two generally rounded portions.

6. The fuel rail assembly according to claim 1, wherein the damper element includes three generally rounded portions.

7. The fuel rail assembly according to claim 1, wherein the damper element includes at least four generally rounded portions.

8. The fuel rail assembly according to claim 1, wherein the damper element comprises a metal.

9. The fuel rail assembly according to claim 1, wherein the damper element comprises a hollow element.

10. The fuel rail assembly according to claim 1, wherein the damper element reduces pressure pulsations in the fluid conduit.

11. The fuel rail assembly of claim 1, wherein the at least one first distance further comprising a first distance from the longitudinal axis of the file rail to the wall and a second distance from the longitudinal damper element axis to the wall of the fuel damper element, wherein the first distance is about twice the second distance.

12. A method of reducing pressure pulsations in a fluid conduit comprising:

providing a fuel rail assembly having:

a generally hollow fuel rail having a longitudinal rail axis extending therethrough; and a fuel damper element having a longitudinal damper element axis extending therethrough, the fuel damper element having a continuous surface of a first surface area in a first configuration and a second surface area in a second configuration such that the second surface area is greater than the first surface area, the fuel damper element being located within the fuel rail; and flowing pressurized fluid between the fuel rail and the fuel damper element.

13. The method according to claim 12, wherein, when the pressurized fluid is in compression, the fuel damper element compresses, and when the pressurized fluid is in tension, the fuel damper element expands.

14. The method according to claim 12, wherein the fuel damper element is an elongated member.

15. The method according to claim 12, wherein the fuel damper element is compressed in two locations, forming two generally rounded portions.

16. The method according to claim 12, wherein the fuel damper element is compressed in three locations, forming three generally rounded portions.

17. The method according to claim 12, wherein the fuel damper element is compressed in four locations, forming four generally rounded portions.

18. The method according to claim 12, wherein, prior to the step of compressing the fuel damper element, the fuel damper element is tubular.

19. A method of forming a fuel rail assembly, comprising:

compressing a wall of an elongated member toward a longitudinal axis of the elongated member in at least two locations along a length of the member that forms at least one generally rounded portion;

sealing the elongated member to prevent ingress of fuel; and inserting the elongated member into a fuel rail.

20. A fuel rail assembly comprising:

a hollow fuel rail having a wall surface disposed about a longitudinal axis;

a fuel damper element disposed within the fuel rail, the damper element having a longitudinal damper element axis and one continuous surface with a plurality of radius of curvature with respect to the long axis, the fuel damper element configured such that fuel flows between the wall surface and the one continuous surface, the one continuous surface includes at least a first section located at a greatest distance from the longitudinal damper element axis, the at least a first section having an uniform radius of curvature about the longitudinal damper element axis.

21. The fuel rail assembly of claim 20, wherein the fuel damper element is configured to float within the hollow fuel rail.

22. The fuel rail assembly of claim 20, wherein the greatest distance is about one-half a distance from the longitudinal axis of the hollow fuel rail to the wall surface of the fuel rail.

* * * * *